US006769559B2

(12) United States Patent
Ziegler et al.

(10) Patent No.: US 6,769,559 B2
(45) Date of Patent: Aug. 3, 2004

(54) VENTING PLASTIC CLOSURE

(75) Inventors: John D. Ziegler, Carmel, IN (US); David E. Babcock, Lafayette, IN (US); Coy Herald, West Lafayette, IN (US)

(73) Assignee: Alcoa Closure Systems International, Crawfordsville, IN (US)

( * ) Notice: Subject to any disclaimer, the term of this patent is extended or adjusted under 35 U.S.C. 154(b) by 0 days.

(21) Appl. No.: 10/303,278

(22) Filed: Nov. 25, 2002

(65) Prior Publication Data

US 2003/0127421 A1 Jul. 10, 2003

Related U.S. Application Data

(63) Continuation of application No. 09/666,522, filed on Sep. 20, 2000, now abandoned.

(51) Int. Cl.[7] ..... B65D 53/00
(52) U.S. Cl. ..... 215/349; 215/351; 215/307
(58) Field of Search ..... 215/349, 350, 215/351, 307

(56) References Cited

U.S. PATENT DOCUMENTS

| | | | | |
|---|---|---|---|---|
| 3,010,596 A | | 11/1961 | Williams et al. | |
| 3,033,407 A | | 5/1962 | Isele-Aregger | |
| 3,300,072 A | | 1/1967 | Caviglia | |
| 3,409,160 A | | 11/1968 | Scott | |
| 3,428,208 A | | 2/1969 | Kosar | |
| 3,536,224 A | | 10/1970 | Green | |
| 3,844,439 A | | 10/1974 | Demers et al. | |
| 4,418,828 A | | 12/1983 | Wilde et al. | |
| 4,497,765 A | | 2/1985 | Wilde et al. | |
| 4,564,117 A | | 1/1986 | Herbert | |
| 4,938,370 A | | 7/1990 | McBride | |
| 5,004,112 A | | 4/1991 | McBride | |
| 5,062,538 A | * | 11/1991 | Ochs | 215/260 |
| 5,542,556 A | * | 8/1996 | Ohmi et al. | 215/329 |
| 5,743,420 A | * | 4/1998 | Loffler et al. | 215/270 |
| 5,785,196 A | * | 7/1998 | Montgomery | 215/354 |
| 5,871,111 A | * | 2/1999 | Pfefferkorn et al. | 215/307 |
| 6,021,912 A | | 2/2000 | Hertrampf | |
| 6,044,994 A | | 4/2000 | Miller | |
| 6,202,870 B1 | * | 3/2001 | Pearce | 215/307 |
| 6,227,391 B1 | * | 5/2001 | King | 215/307 |
| 6,502,710 B1 | * | 1/2003 | Bosl et al. | 215/351 |

FOREIGN PATENT DOCUMENTS

| | | | | |
|---|---|---|---|---|
| DE | 004226935 A1 | * | 2/1994 | 215/307 |
| EP | 0 248 744 | | 9/1987 | |
| GB | 963074 | | 8/1974 | |
| WO | PCT US01/42034 | | 6/2001 | |

* cited by examiner

*Primary Examiner*—Jes F. Pascua
(74) *Attorney, Agent, or Firm*—Stephen D. Geimer; Tracey D. Beiriger

(57) ABSTRACT

A venting plastic closure for use with an associated container includes an outer plastic cap having a top wall portion and an annular depending skirt including an internal thread formation. A disc-shaped sealing liner is positioned on the inside surface of the top wall portion for creating a top/inside seal with the associated container. In order to facilitate venting of gas pressure from within the container, and to facilitate removal of the closure from the container by consumers, the closure includes one or more positive stop elements which engage the container after the sealing liner of the closure has been sealingly engaged therewith. The stop elements act to limit the degree of sealing engagement between the sealing lines of the closure and the finish of the closure.

17 Claims, 6 Drawing Sheets

FIG. 1
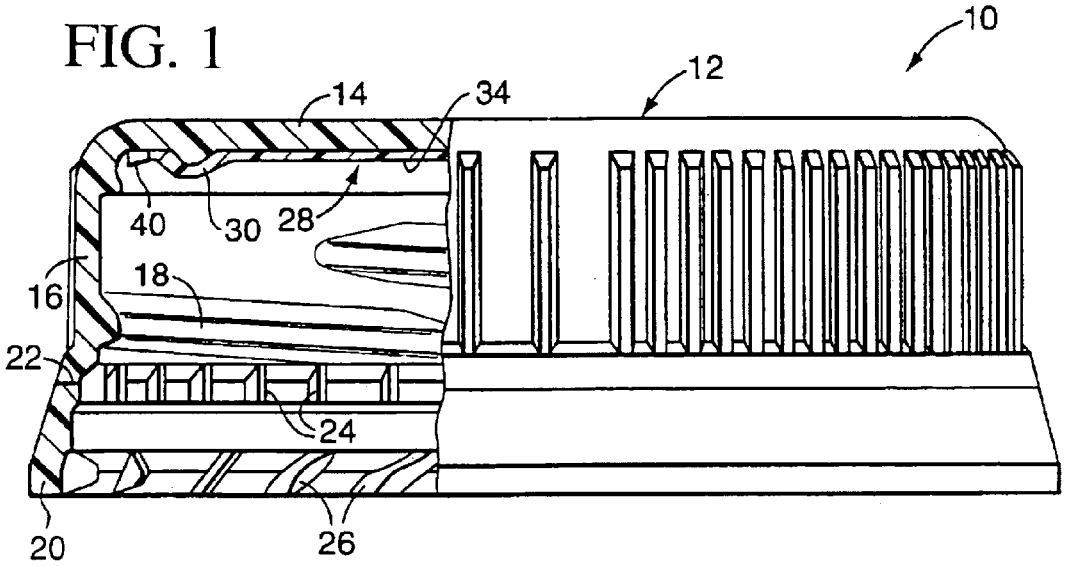
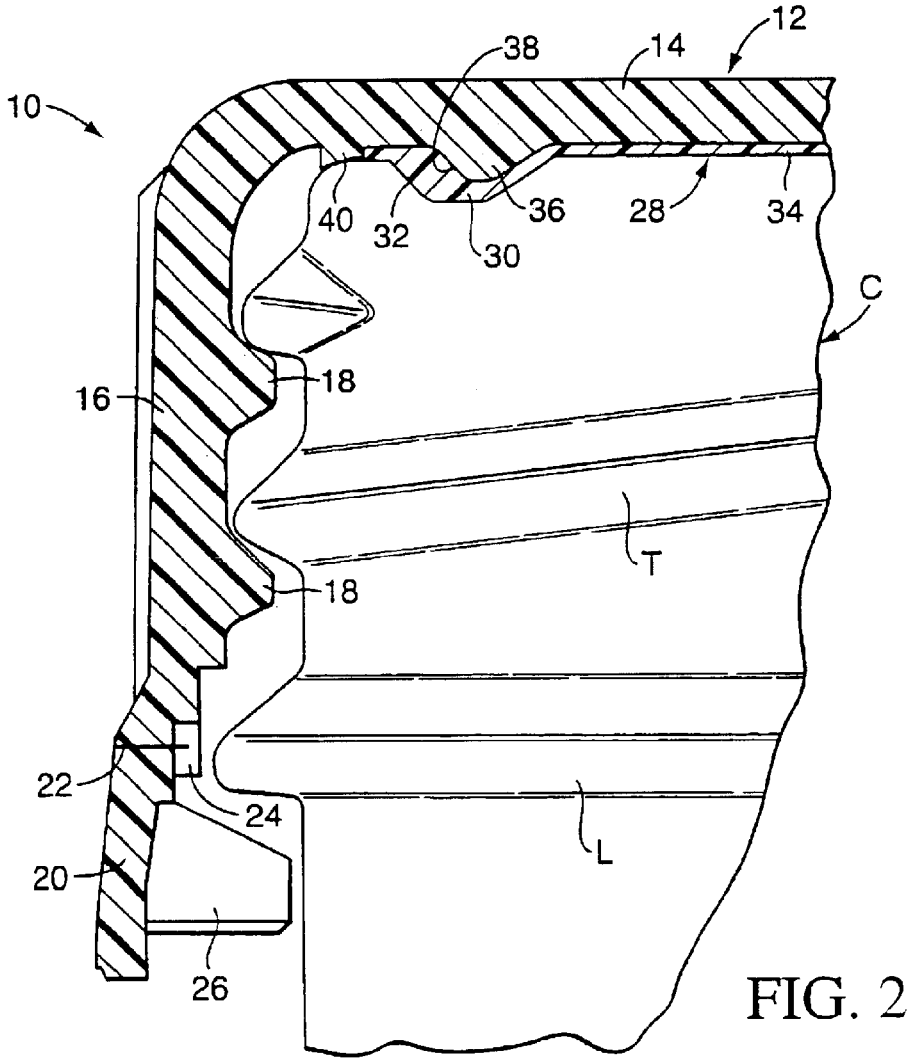
FIG. 2

VENTING PLASTIC CLOSURE

CROSS-REFERENCE TO RELATED APPLICATIONS

This application is a continuation of U.S. patent application Ser. No. 09/666,522, filed Sep. 20, 2000, now abandoned.

TECHNICAL FIELD

The present invention relates generally to a plastic closure for use with an associated container, and more particularly to an internally threaded plastic closure having at least one container-engaging stop element for limiting sealing engagement of the closure with the container, thereby facilitating venting of gas pressure from within the container, and removal of the closure from the container by consumers. The present invention also contemplates a method of packaging a hot-fill beverage which facilitates venting of gas pressure.

BACKGROUND OF THE INVENTION

Threaded plastic closures have found very widespread application for use in connection with bottles and like containers by virtue of their economical manufacture and sealing performance. Closures of this nature typically include an outer plastic closure cap having an internal thread formation, and a sealing liner positioned adjacent the inside surface of a top wall portion of the outer cap. As the closure is threadingly applied to an associated container, the sealing liner is urged into sealing engagement with the sealing container. Threaded fitment of the closure to the container facilitates initial application of the closure, as well as re-application of the closure to the container by consumers after partial consumption of the container's contents.

While closures of the above type have proven very commercially successful, over-application of the closures to containers can be problematic. When closures are applied to containers, either by high-speed capping equipment or by consumers, closures can be applied with a torque which exceeds that required for effecting the desired sealing engagement with the associated container. As will be appreciated, over-application can undesirably result in closures which are difficult for consumers to remove. This problem has been recognized in connection with closures having multi-lead thread formations, which are sometimes used on so-called "hot-fill" beverages, that is, those filled at elevated temperatures. To control application, these types of closures typically have external marks ("pull-ups") that are used with reference to marks on the container finish to indicate the degree to which the closure has been applied.

Apart from high removal torque, over-application of closures can be of concern in connection with the build-up of gas pressure within a container, such as the result of product fermentation caused by spoilage. Over-application of a closure can undesirably inhibit the closure's venting characteristics. This occurs because the degree of sealing engagement between the closure and the container is beyond that which is necessary to achieve sealing integrity under normal conditions. As a consequence, deformation of the closure under the influence of internal gas pressure is insufficient to move the closure out of sealing engagement with the container.

The present invention is directed to an improved closure construction for a container which facilitates closure removal and venting of internal gas pressure by obviating problems associated with over-application of the closure.

SUMMARY OF THE INVENTION

A venting plastic closure embodying the principles of the present invention is particularly suited for use with an associated container having contents which ferment or otherwise spoil, resulting in the creation of internal gas pressure within the container. By virtue of the closure's configuration, venting of gas pressure from within the container to acceptable levels is accommodated. The closure is configured to facilitate venting even in the event of over-application of the closure to the container, such as can occur attendant to the use of high-speed automated capping equipment, as well as facilitating convenient closure removal by consumers. A method of packaging a hot-fill beverage is also disclosed.

A venting plastic closure embodying the principles of the present invention includes an outer plastic cap having a top wall portion, and a depending annular skirt portion. The skirt portion includes at least one internal thread formation and may include plural, multi-lead threads.

The closure includes a disc-shaped sealing liner positioned on an inside surface of the top wall portion, with the liner configured for sealing engagement with the associated container. To this end, the liner is spaced inwardly of the annular skirt portion, and includes a depending annular sealing bead having a generally downwardly and outwardly facing sealing surface. This sealing surface is configured for sealing engagement with a generally upwardly and inwardly facing portion of the associated container, to form what is referred to as a "top/inside seal".

In accordance with the present invention, the outer plastic cap of the present closure includes at least one positive stop element engageable with the associated container. The stop element may be configured in various forms in accordance with the present invention. In accordance with one form, a plurality of circumferentially spaced stop elements depend from the inside surface of the top wall portion. In accordance with the preferred embodiment, each stop element has a generally downwardly, facing stop surface engageable with the associated container. In an alternate embodiment, the positive stop element is positioned on the closure skirt portion, preferably adjacent the thread formation of the closure for engagement with a cooperating thread formation on the associated container. When the closure is configured to include a plurality of thread formations, the closure may include a like plurality of stop elements respectively positioned adjacent the thread formations.

Features of the present closure facilitate efficient sealing with the associated container. In the preferred form, the outer plastic cap includes an annular liner support element which depends from the inside surface of the top wall portion. The support element is positioned within the annular sealing bead of the sealing liner, positioned inwardly of and generally parallel to the generally downwardly and outwardly facing sealing surface of the sealing liner. The sealing liner is preferably efficiently formed by compression molding, and preferably includes a relatively thin central panel portion, positioned inwardly of the annular sealing bead, for efficient use of liner material.

In one form, the annular stop elements depending from the inside surface of the top wall portion are positioned radially outwardly of the sealing liner, whereby each stop surface of each stop element is exposed for engagement with the associated container. In an alternate embodiment, the stop element depends from the inside surface of the top wall beneath the sealing liner, and thus cooperation with the container, while the surface of the stop element does not actually contact the container.

Other features and advantages of the present invention will become readily apparent from the following detailed description, the accompanying drawings, and the appended claims.

BRIEF DESCRIPTION OF THE DRAWINGS

FIG. 1 is a side elevational view, in partial cross-section, of a venting plastic closure embodying the principles of the present invention;

FIG. 2 is a fragmentary, cross-sectional view of the venting plastic closure shown in FIG. 1;

DETAILED DESCRIPTION

Figure 2A:
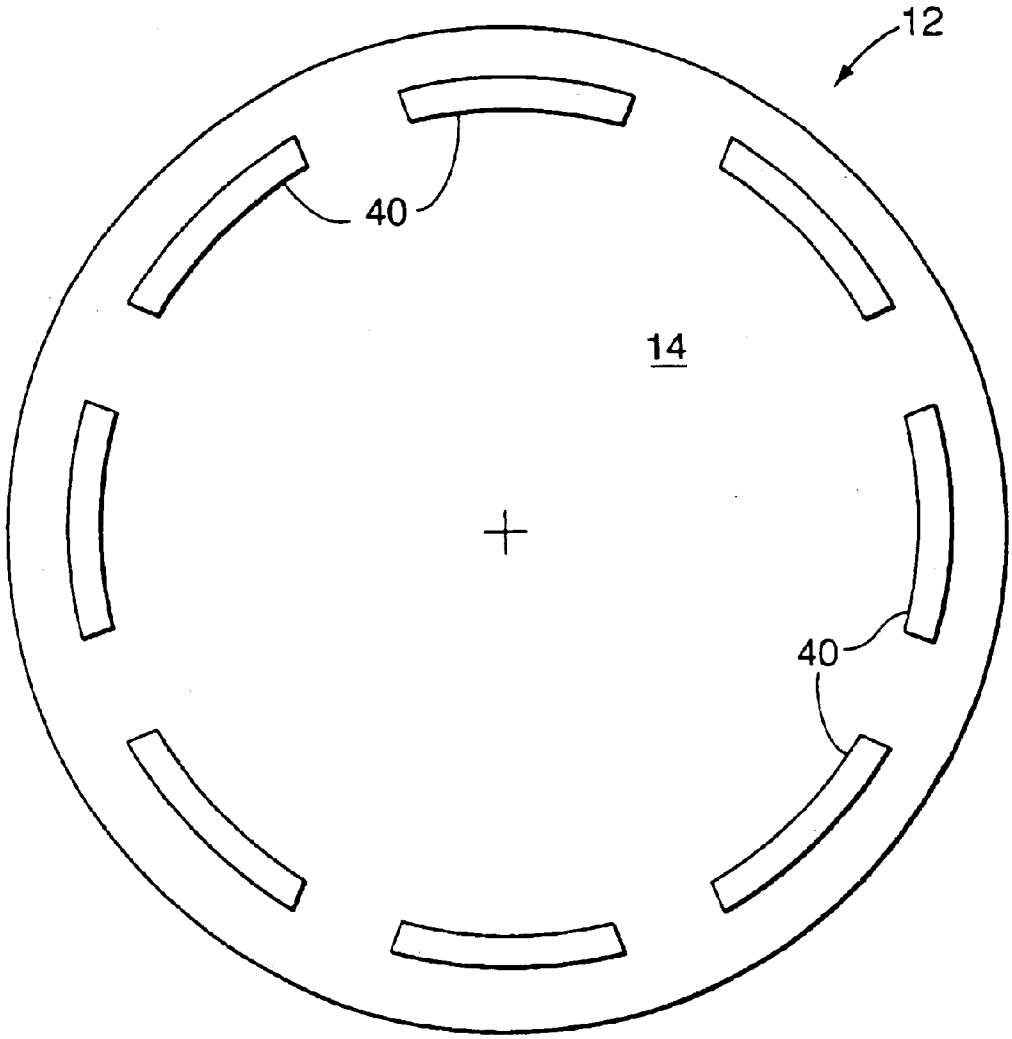
FIG. 2*a* is a diagrammatic view of the inside surface of the closure cap top wall portion.

While the present invention is susceptible of embodiment in various forms, there is shown in the drawings, and will hereinafter be described, presently preferred embodiments, with the understanding that the present disclosure is to be considered as an exemplification of the invention, and is not intended to limit the invention to the specific embodiments illustrated.

With reference first to FIGS. 1 and 2, therein is illustrated a venting plastic closure 10 embodying the principles of the present invention. Plastic closure 10 has been particularly configured for use on bottles or like containers, such as container C, containing beverages or other liquids. The present closure has been particularly configured for use on so-called "hot-fill" beverages, that is, beverages which are introduced into an associated container during packaging when the beverage is at a relatively elevated temperature. However, the present closure construction can be advantageously employed on containers having other types of contents.

While the present closure construction can be manufactured by various techniques, manufacture of the present closure by compression molding is presently preferred. U.S. Pat. No. 4,497,765, hereby incorporated by reference, discloses a method and apparatus for forming plastic closures including in situ compression molded liners.

Venting plastic closure 10 includes an outer plastic cap 12 having a top wall portion 14, and annular skirt portion 16. The skirt portion 16 includes at least one internal thread formation 18 configured for engagement with a cooperating container thread formation T. Plural, multi-lead thread formations can be advantageously employed for obtaining the desired closure retention, while permitting the closure to be removed from the container with minimum relative rotation.

In the illustrated form, the plastic closure 10 is configured to provide tamper-evidence. The closure includes a pilfer band 20 depending from annular skirt portion 16. The pilfer band is distinguished from the skirt portion 16 by circumferentially extending score line 22, which extends inwardly to a plurality of internal frangible ribs or bridges 24 which at least partially detachably connect the pilfer band 20 to the skirt portion 16. The pilfer band 20 includes a plurality of circumferentially spaced, inwardly extending flexible projections 26 which are configured for cooperative engagement with a locking ring L of container C such that during closure removal, the engagement of the projections 26 with the locking ring L results in breakage of bridges 24, and at least partial or complete separation of the pilfer band 20 from the skirt portion 16. The closure pilfer band can be configured in accordance with U.S. Pat. No. 4,418,828, hereby incorporated by reference. It is to be understood that the closure pilfer band can be otherwise configured, such as in accordance with the teachings of U.S. Pat. No. 4,938,370, to McBride, and U.S. Pat. No. 5,004,112, to McBride, both hereby incorporated by reference.

In order to effect the desired sealing cooperation with an associated container, venting plastic closure 10 includes a disc-shaped sealing liner 28 positioned adjacent the inside surface of top wall portion 14 of closure cap 12. The sealing liner is preferably compression molded within the outer closure cap during closure manufacture, and is configured for effecting a so-called "top/inside seal" with the associated container C. To this end, the sealing liner includes a depending annular sealing bead portion 30 having a generally downwardly and outwardly facing sealing surface 32, shown in an undeformed configuration in FIG. 2 in relation to a generally upwardly and inwardly facing portion of the associated container C. When formed in accordance with the preferred compression molding technique, the sealing liner 28 includes a relatively thin central panel portion 34 positioned inwardly of sealing bead 30.

In the preferred form, the outer closure cap includes an annular liner support element 36 depending from the inside surface of top wall portion 14. The liner support element is positioned within the annular sealing bead 30 of liner 28, and defines a liner support surface 38 positioned inwardly of and generally parallel to sealing surface 32 of liner 28. The liner support element 36 cooperates with the sealing bead 30 of sealing liner 28 to effect sealing engagement of the sealing bead with the surface of the associated container C, and also desirably reduced the quantity of relatively expensive liner material employed in the closure.

As discussed, fermentation or other spoilage of the contents of container C can occasionally take place. As a consequence, gas pressure within the container can become elevated, with it therefore being desirable for the closure 10 to flex and deform outwardly to a sufficient degree such that the sealing liner 28 is dislodged from sealing engagement with the associated container. Under such circumstances, gas pressure from within the container can be vented to the atmosphere.

In accordance with the present invention, the closure 12 is configured to facilitate such venting of gas pressure by obviating problems associated with over application of closures to containers. Such over application can preclude the sealing liner of a closure from becoming sufficiently disengaged from the associated container as to permit venting. To this end, a plastic closure configured in accordance with the present invention includes at least one positive stop element engageable with the container for limiting the sealing engagement between the closure and the associated container. In accordance with the embodiment illustrated in FIG. 1, the outer closure cap 12 includes at least one, and preferably a plurality, of positive stop elements 40 depending from the inside surface of the top wall portion 14. In this embodiment, each stop element 40 is positioned radially outwardly of sealing liner 28, and is positioned for engagement with a generally upwardly facing surface of the associated container C. Accordingly, each stop element 40 defines a generally downwardly facing stop surface, which in the illustrated form, is non-horizontal, extending angularly upwardly and inwardly so that the stop surface faces generally downwardly and inwardly. Thus, in cross-section, the stop element 40 is generally trapezoidal.

While it is within the purview of the present invention that the stop element 40 be provided in the form of a continuous annulus, it is presently preferred that a plurality of circumferentially spaced stop elements be provided depending from the top wall portion 14. As illustrated in FIG. 2*a*, a plurality of stop elements 40 can be provided, spaced circumferentially at 45° intervals. Each stop element is configured to subscribe an angle of about 30° degrees. The specific number of stop elements may be varied in keeping with the principles disclosed herein.

Figure 6:
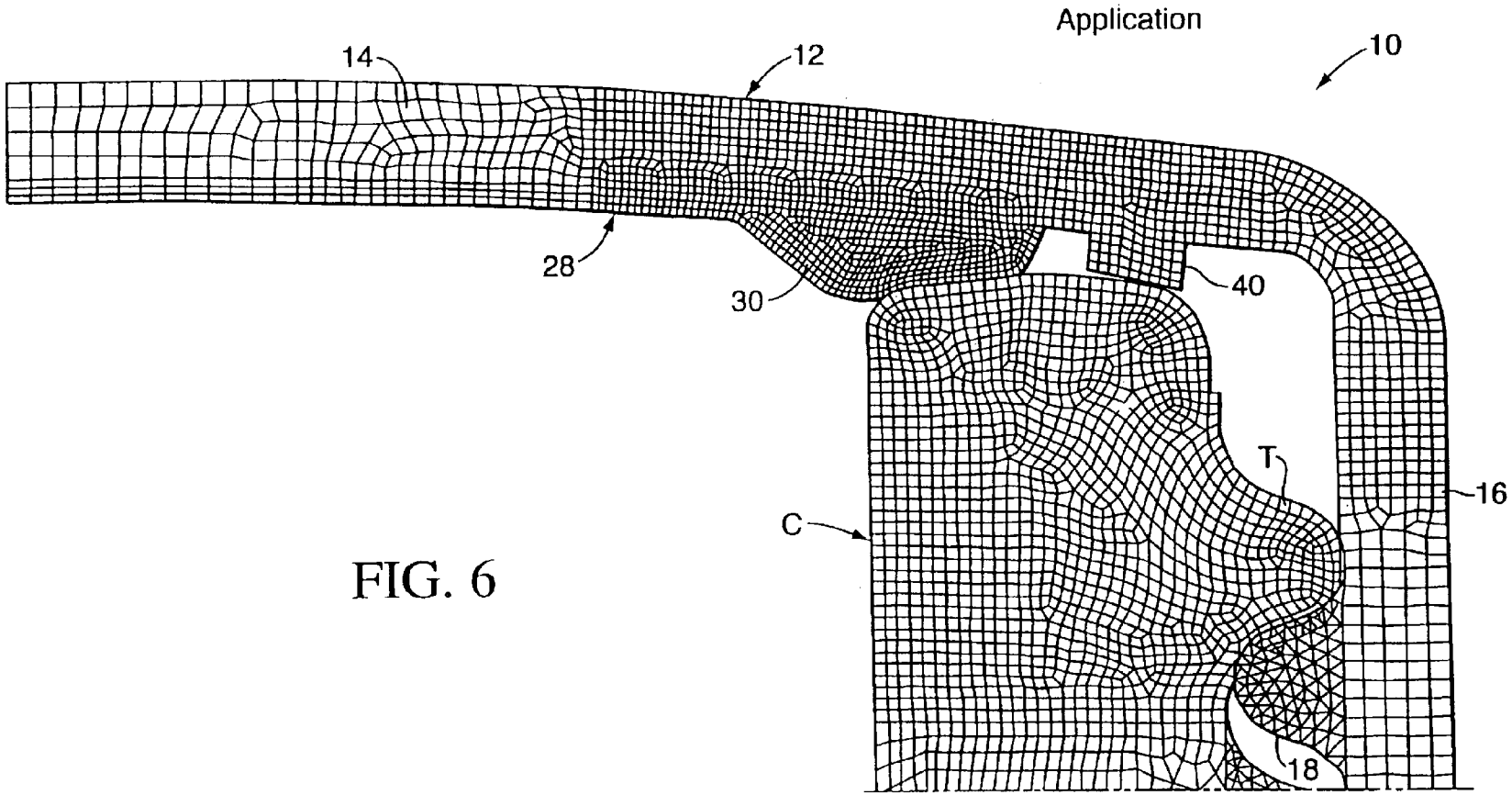
FIG. 6 is a finite element analysis of a venting plastic closure configured in accordance with the present invention.

With particular reference to FIG. 6, therein is illustrated a finite element analysis of a plastic closure configured in accordance with the present invention, including a stop element 40 having an inwardly and upwardly angled stop surface (this illustrated closure does not include an annular support element 36 positioned within sealing bead 30 of liner 28). By this illustration, the cooperative action of stop element 40 with container C, and the associated sealing liner 28, is readily apparent. By cooperation of the stop element with the finish of the associated container, the stop element 40 acts to limit the sealing engagement created between the sealing bead 30 of liner 28 and the finish of the container C. Venting of gas pressure from within the container is thus facilitated. Additionally, because sealing engagement of the closure and the container is limited, removal of the closure from the container by consumers is facilitated.

Figure 3:
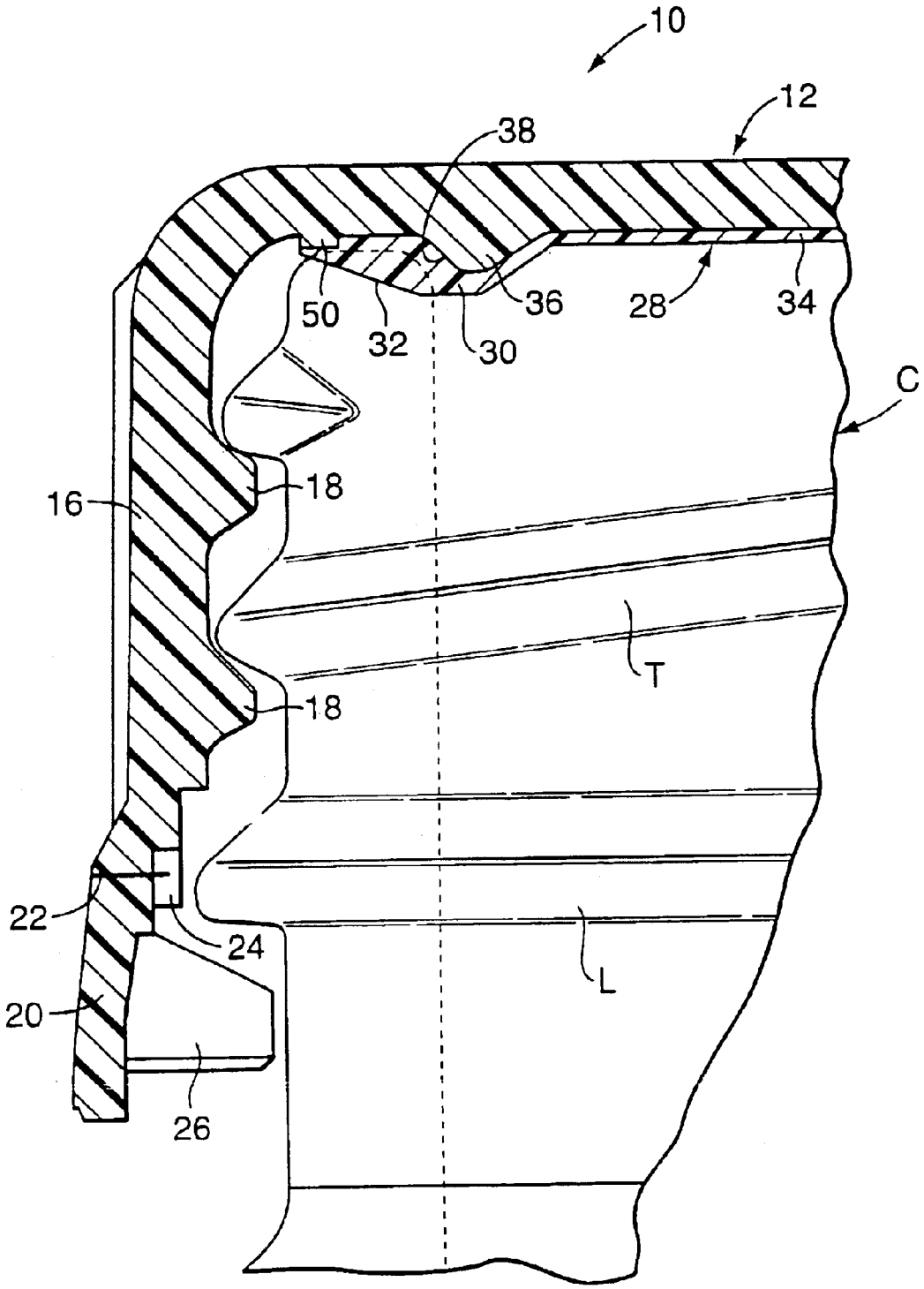
FIG. 3 is a fragmentary, cross-sectional view of an alternate embodiment.

With reference to FIG. 3, therein is illustrated an alternate embodiment of the present closure 10, including an alternately configured stop element, designated 50. In this embodiment, the stop element 50 depends from the top wall portion 14, but is positioned beneath sealing liner 28. Thus, the stop element itself does not engage the associated container C, but rather acts through the sealing liner 28 to limit engagement of the closure liner with the associated container. As in the previously-described embodiment, a plurality of the stop elements 50 are preferably provided depending from the inside surface of top wall portion 14, positioned in circumferentially spaced relationship on the inside surface of the top wall portion.

Figure 4:
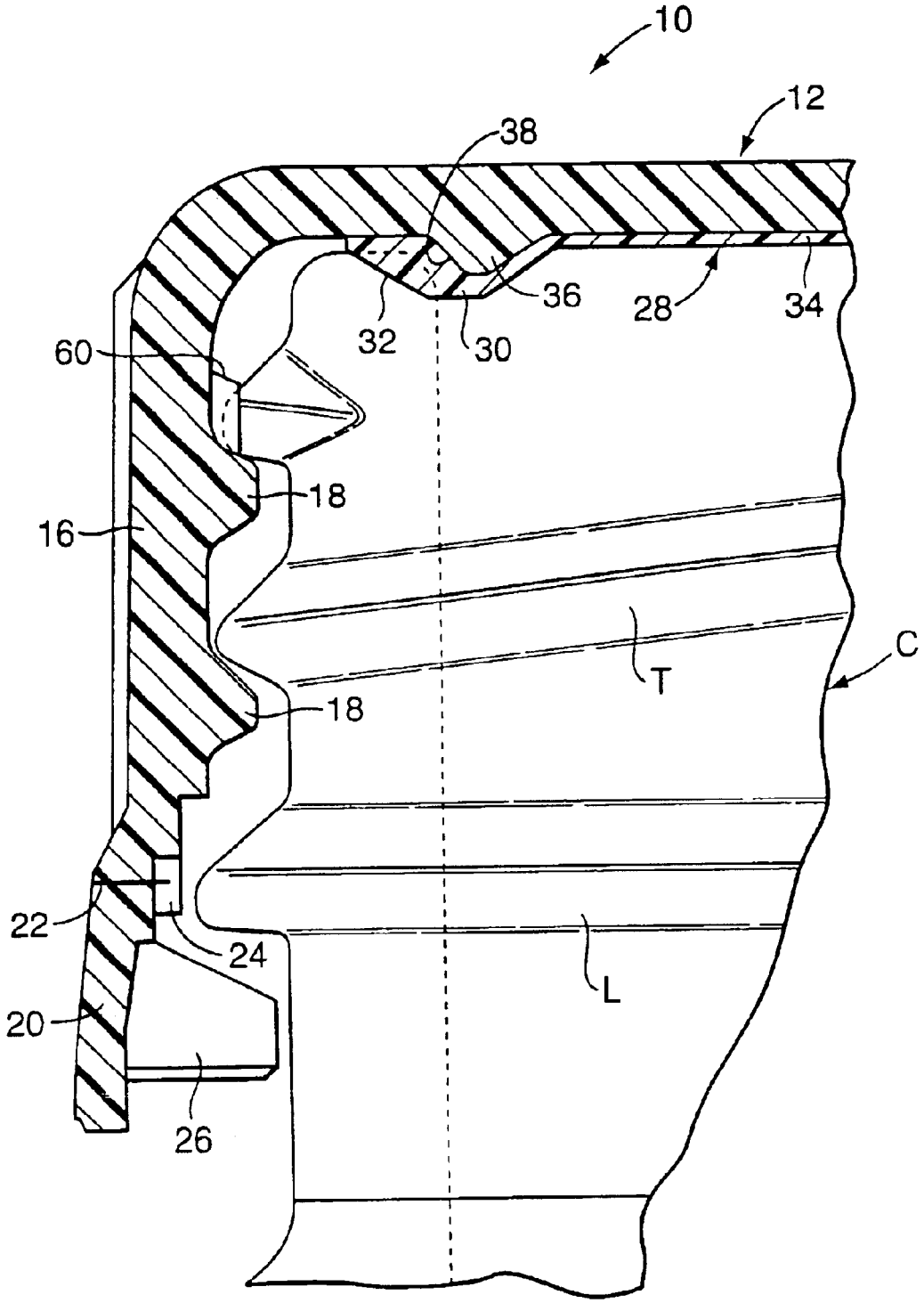
FIG. 4 is a fragmentary, cross-sectional view of a further alternate embodiment of the present venting plastic closure.

FIG. 4 illustrates a further alternate embodiment of the present closure 10, including a positive stop element 60 engageable with container C. In this embodiment, the stop element 60 is positioned on the interior surface of skirt portion 16 adjacent to closure thread 18, and is thus positioned for engagement with the leading portion of the container thread T. As in accordance with the previous embodiments, engagement of positive stop element 60 with the container C acts to limit sealing engagement of the closure with the container, thus facilitating release gas pressure from within the container, and removal of the closure from the container by consumers. If the closure and the container are configured to include a plurality of thread formations, i.e., multi-lead threads, it is contemplated that a like plurality of the stop elements 60 be provided respectively positioned adjacent each of the thread formations for respective engagement with the thread formations on the container C.

Figure 5:
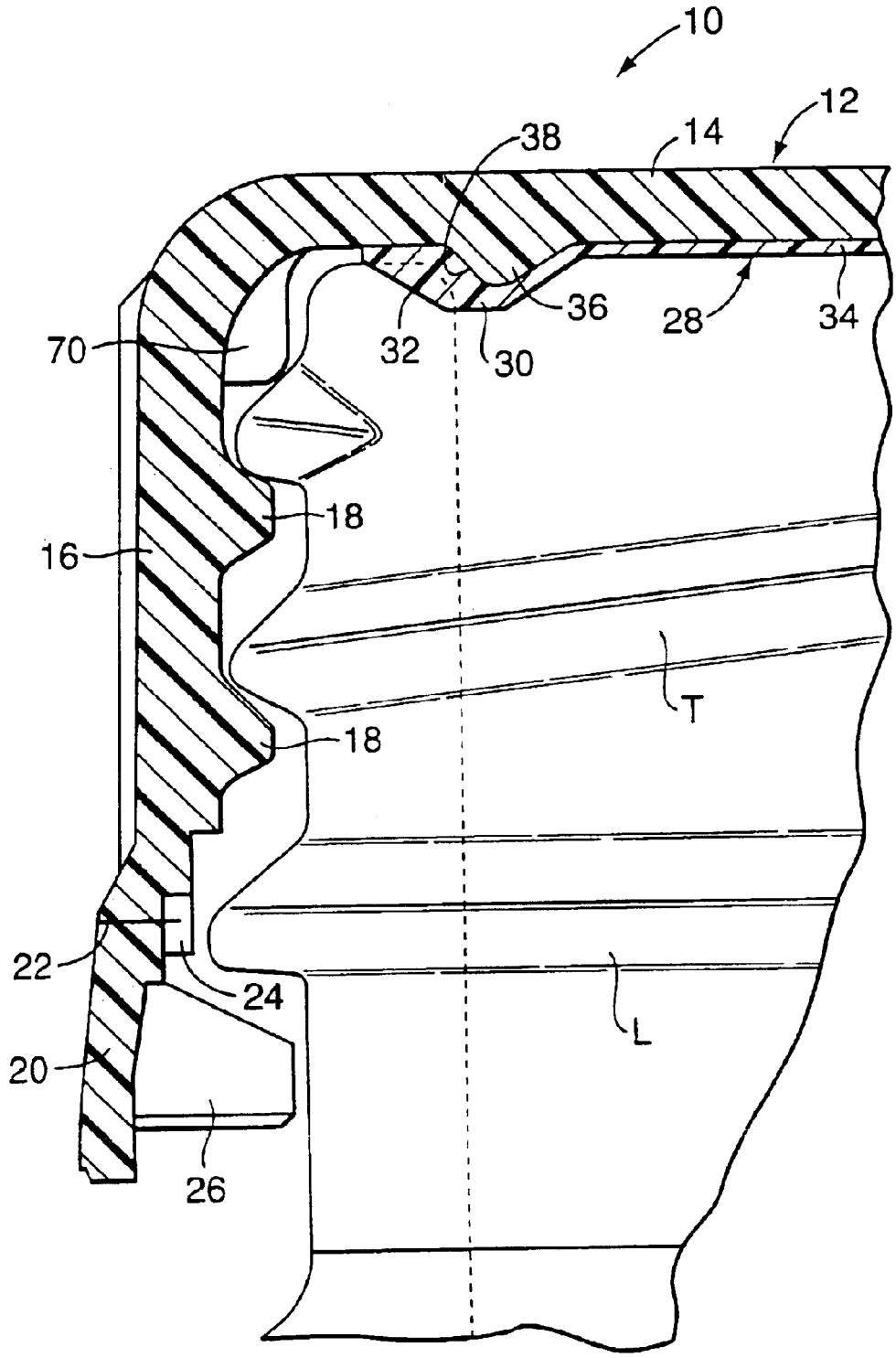
FIG. 5 is a fragmentary, cross-sectional view of a further alternate embodiment of the present venting closure.

FIG. 5 illustrates a further alternate embodiment of the present closure 10, including a stop element 70 engageable with container C. Like the previously-described embodiment, this stop element is positioned on the interior surface of the skirt portion 16 of the closure, but generally at the juncture of the skirt portion 16 and top wall portion 14 in spaced relationship to thread formation 18. Stop element 70 is configured for positive engagement with the container thread T, but generally acts against an upwardly facing surface of the container thread.

Thus, an improved venting closure is disclosed which facilitates release of gas pressure from within an associated container, and facilitates removal of the closure from a container by consumers. In each of the illustrated embodiments, the one or more positive stop elements are configured such that they do not act to limit closure application until the annular bead portion 30 of the sealing liner 28 has compressed sufficiently to effect a hermetic seal. This is illustrated in the finite element analysis illustration of FIG. 6, wherein the sealing bead 30 is illustrated after initial contact of the positive stop 40 with the finish of container C. Testing has shown that by providing one or more positive stops in the closure 10, the stops increase the application torque by three to four times to achieve the degree of sealing angle, in comparison to a similarly configured closure without positive stops. This desirably permits a bottler to effectively use static torque to prevent over-application.

Testing has further demonstrated that when the positive stop elements are positioned to depend from the top wall portion, and the one or more positive stops of the closure become fully engaged with the top of the container finish, the venting pressure actually decreases as the closure is further applied. It will be appreciated from the finite element analysis that this decrease in venting pressure occurs as the one or more stops act to lift the liner 28 away from the container finish as the closure is further applied to the container.

From the foregoing, numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A venting plastic closure for use with an associated container, said closure comprising:

an outer plastic cap having a top wall portion, and a depending annular skirt portion having an internal thread formation; and a disc-shaped sealing liner positioned on an inside surface of said top wall portion, said liner being spaced inwardly of said annular skirt portion, and including a depending annular sealing bead having a generally downwardly and outwardly facing sealing surface for sealing engagement with a generally upwardly and inwardly facing portion of an associated container;

said outer plastic cap including an annular liner support element depending from the inside surface of said top wall portion, said liner support element being positioned within said annular sealing bead of said sealing liner, said outer plastic can further including at least one positive stop element engageable with said associated container after said sealing bead portion has been positioned in sealing engagement to facilitate closure removal and venting of gas pressure from within said container.

2. A venting plastic closure in accordance with claim 1, wherein:

said stop element depends from the inside surface of said top wall portion.

3. A venting plastic closure in accordance with claim 2, wherein:

said stop element has a generally downwardly, inwardly facing stop surface engageable with said associated container.

4. A venting plastic closure in accordance with claim 2, wherein:

said plastic cap includes a plurality of circumferentially spaced stop elements.

5. A venting plastic closure in accordance with claim 2, wherein:

said stop element depends from the inside surface of said top wall portion radially outwardly of said sealing liner.

6. A venting plastic closure in accordance with claim 1, wherein:

said skirt portion includes at least one internal thread formation, said stop element being positioned adjacent said thread formation for engagement with a cooperating thread formation on said associated container.

7. A venting plastic closure in accordance with claim 6, wherein:

said skirt portion includes a plurality of thread formations, said closure including a like plurality of said stop elements respectively positioned adjacent said thread formations.

8. A venting plastic closure in accordance with claim 1, wherein:

said annular support element defines a liner support surface positioned inwardly of and generally parallel to the sealing surface of said sealing liner.

9. A venting plastic closure in accordance with claim 1, wherein:

said sealing liner includes a relatively thin center panel portion positioned inwardly of said annular sealing bead.

10. A venting plastic closure in accordance with claim 1, wherein:

said skirt portion includes at least one internal thread formation, said stop element being positioned on said skirt portion in spaced relationship to said internal thread formation for engagement with a cooperating thread formation on said associated container.

11. A venting plastic closure for use with an associated container, comprising:

an outer plastic cap having a top wall portion, and a depending annular skirt portion having at least one internal thread formation; and a disc-shaped sealing liner positioned on an inside surface of said top wall portion, said liner being spaced inwardly of said annular skirt portion, and including a relatively thin central panel portion and a depending annular sealing bead having a generally downwardly and outwardly facing sealing surface for sealing engagement with a generally upwardly and inwardly facing portion of said associated container;

said plastic cap including an annular liner support element depending from the inside surface of said top wall portion, said liner support element defining a liner support surface positioned inwardly of the sealing surface of said sealing liner;

said outer plastic cap including an annular liner support element depending from the inside surface of said top wall portion, said liner support element being positioned within said annular sealing bead of said sealing liner, said outer plastic cap further including at least one positive stop element engageable with said associated container, said stop element depending from the inside surface of said top wall portion, said stop element having a generally downwardly facing stop surface for cooperation with said container.

12. A venting plastic closure in accordance with claim 11, wherein:

said stop surface is generally downwardly and inwardly facing.

13. A venting plastic closure in accordance with claim 11, wherein:

said stop element is positioned radially outwardly of said sealing liner.

14. A venting plastic closure in accordance with claim 11, wherein:

said plastic cap includes a plurality of circumferentially spaced stop elements depending from said top wall portion.

15. A method of packaging a hot-fill beverage, comprising the steps of:

providing a container;

providing a plastic closure including an outer cap having a top wall portion and an annular depending skirt portion, and a disc-shaped sealing liner positioned on an inside surface of said top wall portion spaced inwardly of said skirt portion, said liner including a depending annular-sealing bead, said outer cap including an annular liner support element depending from the inside surface of said top wall portion, said liner support element being positioned within said annular sealing bead of said sealing liner, said outer plastic can further including at least one positive stop element engageable with said container;

filling said container with said beverage; and applying said closure to said container so that said sealing bead of said disc-shaped liner engages a generally upwardly and inwardly facing portion of said container, and so that said positive stop element thereby cooperates with said container to limit sealing engagement of said sealing bead with said container to thereby facilitate venting of gas pressure from within said container.

16. A method of packaging a beverage in accordance with claim 15, wherein:

said stop element depends from said top wall portion of said outer cap.

17. A method of packaging a beverage in accordance with claim 16, wherein:

said outer cap includes a plurality of circumferentially spaced stop elements.

* * * * *

UNITED STATES PATENT AND TRADEMARK OFFICE

CERTIFICATE OF CORRECTION

PATENT NO. : 6,769,559 B2
DATED : August 3, 2004
INVENTOR(S) : John D. Ziegler et al.

It is certified that error appears in the above-identified patent and that said Letters Patent is hereby corrected as shown below:

Column 6,
Line 59, insert -- cap -- delete “can”.

Column 8,
Line 39, insert -- cap -- delete “can”.

Signed and Sealed this

Twenty-fifth Day of October, 2005

JON W. DUDAS
*Director of the United States Patent and Trademark Office*